US006990877B1

(12) United States Patent
Wu

(10) Patent No.: US 6,990,877 B1
(45) Date of Patent: Jan. 31, 2006

(54) TORQUE WRENCH

(76) Inventor: Wun-Sin Wu, P.O. Box 453, Taichung City (TW)

( * ) Notice: Subject to any disclaimer, the term of this patent is extended or adjusted under 35 U.S.C. 154(b) by 0 days.

(21) Appl. No.: 10/888,904

(22) Filed: Jul. 12, 2004

(51) Int. Cl.
*B25B 13/46* (2006.01)
*B25B 23/143* (2006.01)

(52) U.S. Cl. ..... 81/467; 81/482; 81/59.1

(58) Field of Classification Search ..... 81/467, 81/473, 476–478, 480–482, 58.4, 59.1, 63, 81/63.2
See application file for complete search history.

(56) References Cited

U.S. PATENT DOCUMENTS 1,860,871 A * 5/1932 Pouliot ..... 81/480
2,332,971 A * 10/1943 Johnson ..... 81/480
2,556,587 A * 6/1951 Keen ..... 81/482
2,972,271 A * 2/1961 Gill ..... 81/480
6,742,418 B2 * 6/2004 Amami ..... 81/57.39

* cited by examiner

*Primary Examiner*—David B. Thomas
(74) *Attorney, Agent, or Firm*—Egbert Law Offices

(57) ABSTRACT

A torque wrench includes a pressure handle, a sheath end, a directional brake module, an overload movement ring, rolling rods, rolling beads and spring bolsters. The overload movement ring is provided between the brake section of directional brake module and the assembly groove of sheath end. The interior of the overload movement ring is designed with a circular tooth rim for the articulation/brake of the brake section of directional brake module, whereas the exterior is designed with a polygon. Moreover, a containment groove is provided at the intersection of various surfaces to accommodate the rolling rod and rolling bead, thus the outer flank of various rolling rods and rolling beads will protrude the aperture of the containment groove, and then keep in close contact with the wall of the assembly groove. One surface of the overload movement ring is supported and braked by the movable shore of spring bolster.

5 Claims, 6 Drawing Sheets

TORQUE WRENCH

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a torque wrench, and more particularly to a torque wrench which comprises improved structure of overload movement.

BACKGROUND OF THE INVENTION

To avoid structural damage from excessive external force, the torque wrench is typically designed with overload protective measures. So, in case where the applied force of the pressure handle exceeds the preset value, the sheath end and pressure handle will move alternatively, thus preventing structural damage arising from continuous application of force by the user. With regard to a conventional structure of overload protective measure, a ratchet ring is typically mounted within the groove at the sheath end of torque wrench. The interior of the ratchet ring is provided with a supporting surface for articulation during positive and reverse rotation of sheath end, whereas the exterior of the ratchet ring is normally positioned securely by a flexible bead. In case the applied force of the pressure handle of torque wrench exceeds the preset value, the sheath end will activate the ratchet outside the ratchet ring to forcibly cross over the flexible bead, thus the sheath end and pressure handle will move alternatively to prevent structural damage. However, it has been found from practical experience that, owing to the sharp ratchet of ratchet ring, a bigger frictional wear will likely occur between the ratchet and groove of torque wrench during the former one crossing the flexible bead. In such case, the ratchet of ratchet ring will be broken and deformed rapidly, thus reducing the intended function of overload protection at the handle end and greatly shortening the service life of torque wrench. Also, it is unlikely to preset accurately the torque due to the strong friction of movement, leading to an unstable state against ideal utility model. Additionally, there is available with another typical structure for overload protection that is mounted onto the middle section of the pressure handle of the torque wrench. The principle of operation is that overload protection can be achieved through alternative movement of two components. However, if the end users continue to apply force during the movement, the component at one side will further bump the structural body of the pressure handle, leading to consequent damage.

Therefore, with a view to the above-mentioned disadvantages of typical torque wrench, this industry shall assume the responsibility to make some pioneering R& D and innovations for an ideal utility model.

BRIEF SUMMARY OF THE INVENTION

The present invention can offer an improved efficiency as detailed below.

To provide an innovative structure of a torque wrench that the exterior of the overload movement ring 40 is designed with a polygon, and a containment groove 43 is installed at the intersection of various surfaces 42 to accommodate the rolling rod 51 and rolling bead 52. This is a preferred option of this Industry in conformity with the requirements of new patent.

Based upon the modified structural design, as the overload movement ring 40 is placed in a rolling contact state through the rolling rod 51, rolling bead 52 and the assembly groove 21, it is possible to reduce considerably the wear, protect against deformation and prolong the service life of components.

Given the rolling contact feature through the rolling rod 51, rolling bead 52 and assembly groove 21, it is feasible to preset more accurate torque as the overload movement ring 40 can move more smoothly.

Based upon the polygonal structural design of overload movement ring 40, in the case of every movement of torque wrench, the bolster 63 of the movable shore 61 will cross over a rolling rod 51 for flexible reduction, and then protrude and support the next surface 42 to restore initial state. In case where the torque wrench of the present invention moves continuously, the applied force of bolster 63 will present an up-and-down recycling state, thus yielding no structural damage for permanent use and excellent durability.

The new advantages of this invention are as follows:

Based upon the structural design that various surfaces 42B of overload movement ring 40 can be designed with a concave arch, it is possible to promote the torque as it provides a bigger grading angle to the bolster 63 of the movable shore 61 when crossing over the rolling rod 51 and rolling bead 52. Furthermore, this design can prevent continuous cross/movement as the bolster is securely fixed onto the next surface.

DETAILED DESCRIPTION OF THE INVENTION

Figure 1:
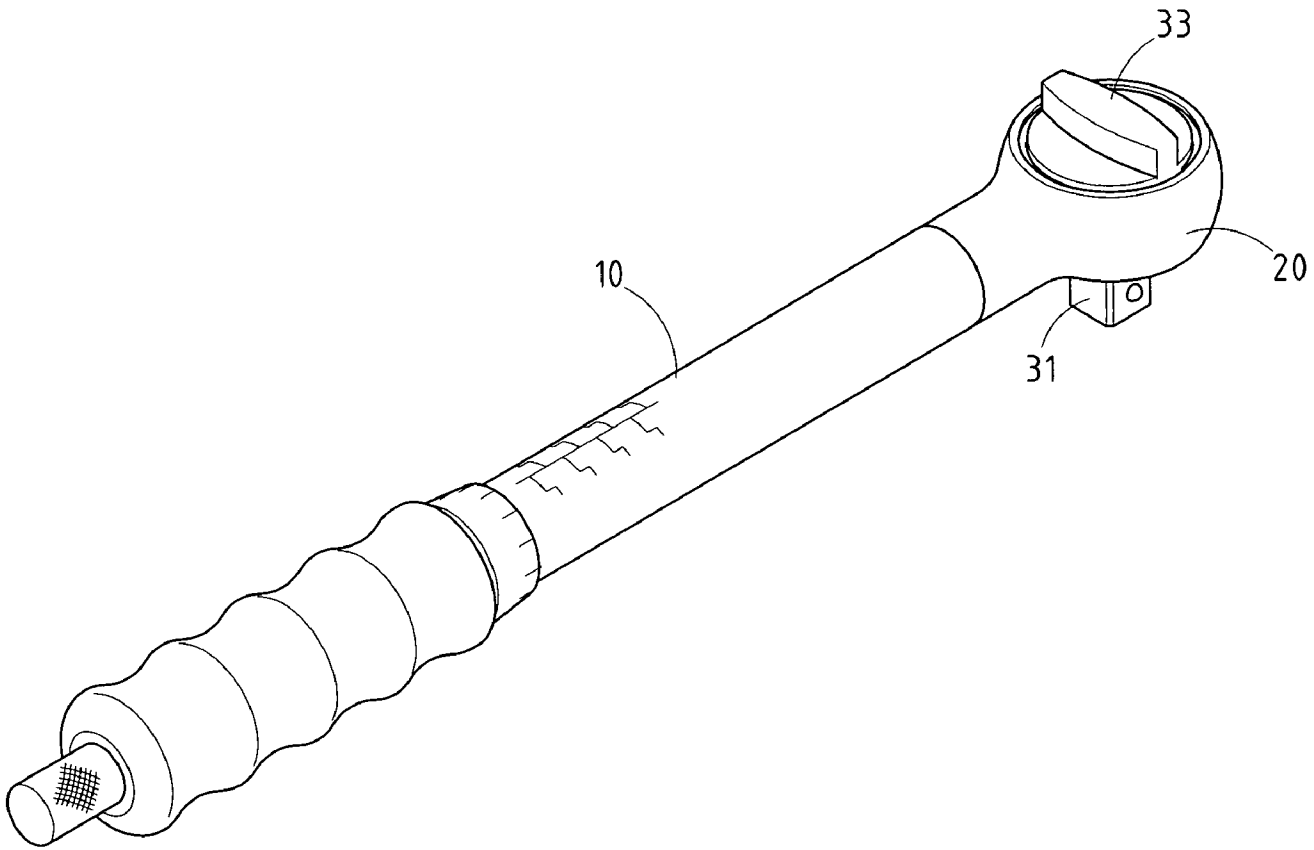
FIG. 1 shows a perspective view of the present invention.
Figure 2:
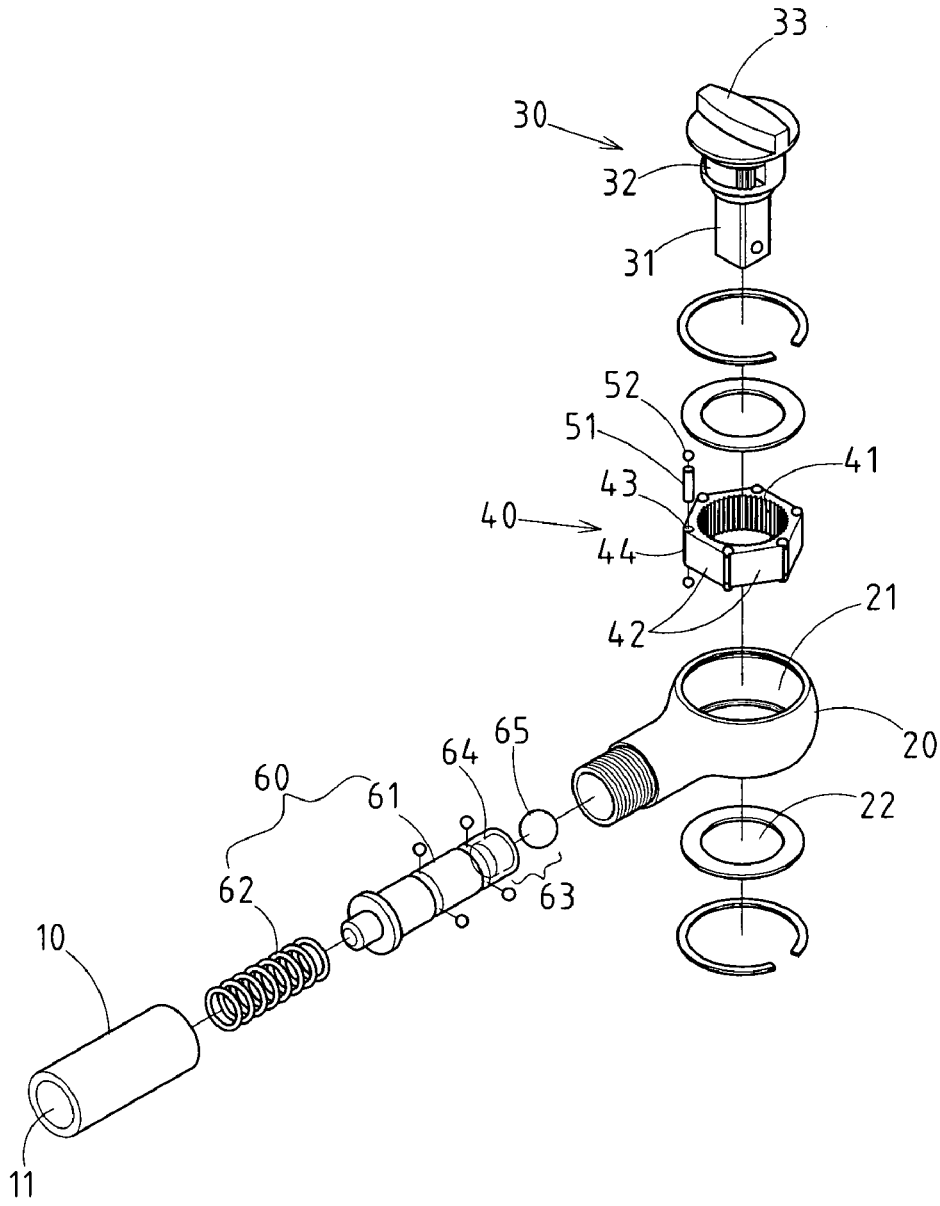
FIG. 2 shows an exploded perspective view of the internal of the invention
Figure 3:
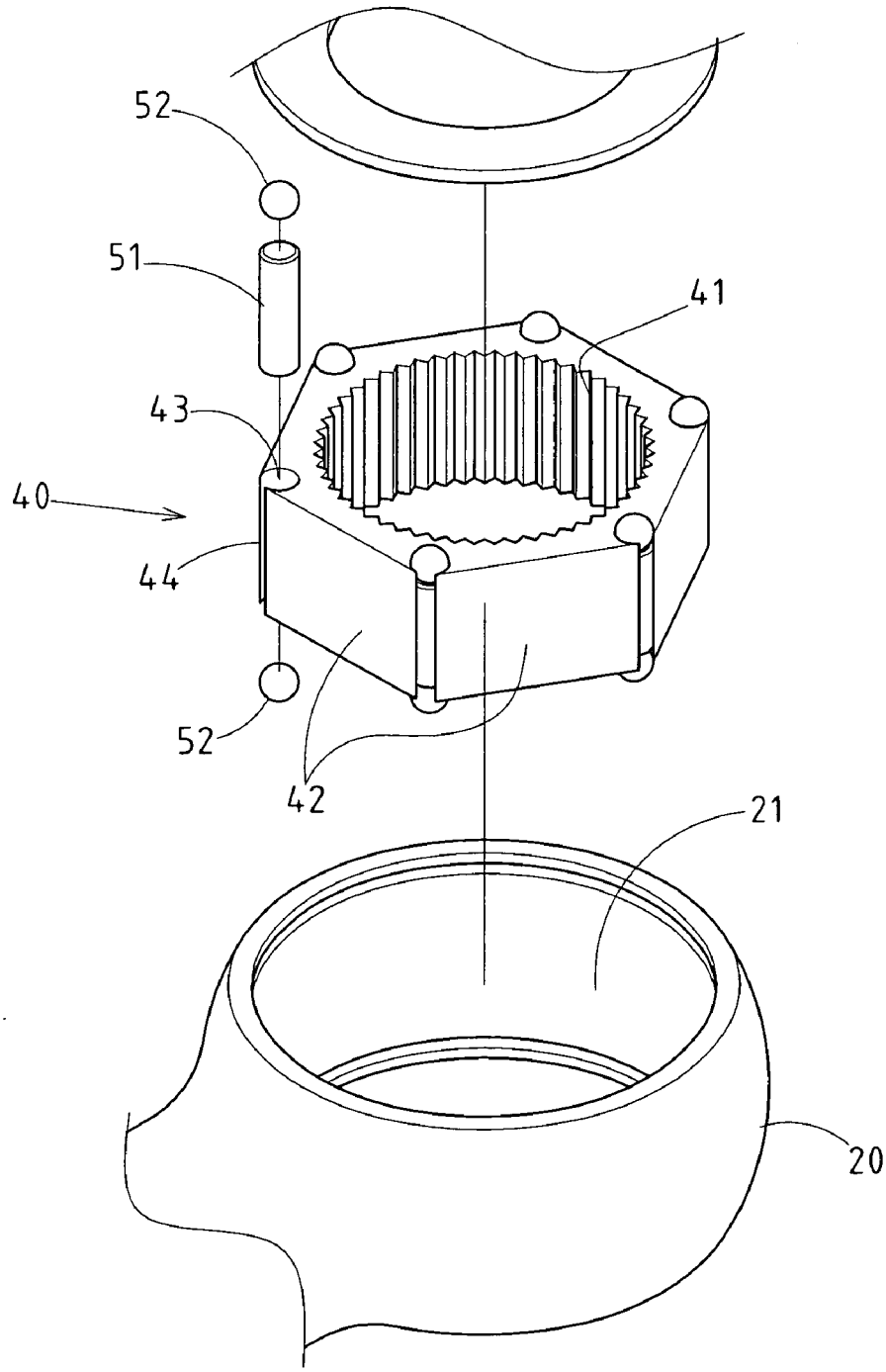
FIG. 3 shows a local magnified perspective view of FIG. 2.

The features and the advantages of the present invention will be more readily understood upon a thoughtful deliberation of the following detailed description of a preferred embodiment of the present invention with reference to the accompanying drawings.

As shown in FIGS. 1–4, there is a torque wrench embodied in the present invention.

The invention has a pressure handle 10, which is provided internally with a hollow hole 11.

The invention also has a sheath end 20, which is provided at one side of the pressure handle 10, and equipped with an assembly groove 21. The assembly groove is provided with a threaded hole 22 at the bottom, while one side of the assembly groove 21 opposite to the pressure handle 10 is connected to the hollow hole 11.

There is also a directional brake module 30, which is mounted within the assembly groove 21 of the sheath end, being comprised of a sheath rod 31, a brake section 32 and a control unit 33. The sheath rod 31, generally designed with a square column, can cross through the threaded hole 22 of the assembly groove 21, whereas the brake section 32 of many types can be provided at the middle section. As shown in the attached drawing, it can be designed with a reversible block, each end of which is provided with positive and reverse brake tooth rim 34, 35, respectively. The control unit 33, designed with a rotary button, is provided at the top, whereby the end users can manually adjust and control the direction (i.e. positive and reverse brake tooth rim for optional articulation) of the brake section 32.

The invention also includes an overload movement ring 40, which is provided between the brake section 32 of directional brake module 30 and assembly groove 21. The interior of the overload movement ring 40 is designed with a circular tooth rim 41 for the articulation/brake of the brake section 32 of directional brake module 30, while the exterior is designed with a polygon. Moreover, a containment groove 43 is provided at the intersection of various surfaces 42 penetrating both sides, and the exterior of various containment grooves is designed with a reducing aperture 44 corresponding to the wall of assembly groove 21.

The invention has a rolling rod 51 and rolling bead 52, which are provided within various containment grooves 43 at the exterior of overload movement ring 40. In detail, each end of a rolling rod 51 is equipped a rolling bead 52, thus the outer flank of various rolling rods 51 and rolling beads 52 will protrude the aperture 44 of the containment groove 43, and then keep in close contact with the wall of the assembly groove 21.

There is also a spring bolster 60, provided within the hollow hole 11 of the pressure handle 10, comprised of a movable shore 61 and a spring 62. One end of the movable shore 61 is supported by the spring 62 while the other end has a bolster 63 that crosses over the assembly groove 21 of the sheath end 20, and supports a surface 42 corresponding to the exterior of the overload movement ring 40. This will help brake the overload movement ring 40 (namely avoiding movement).

Figure 4:
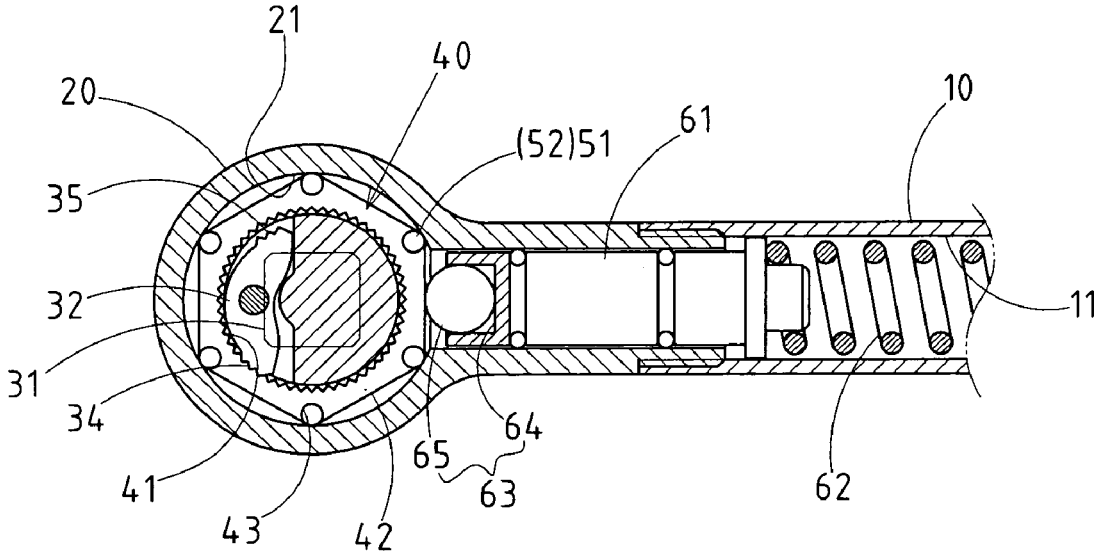
FIGS. 4–5 shows sectional views of the present invention.
Figure 5:
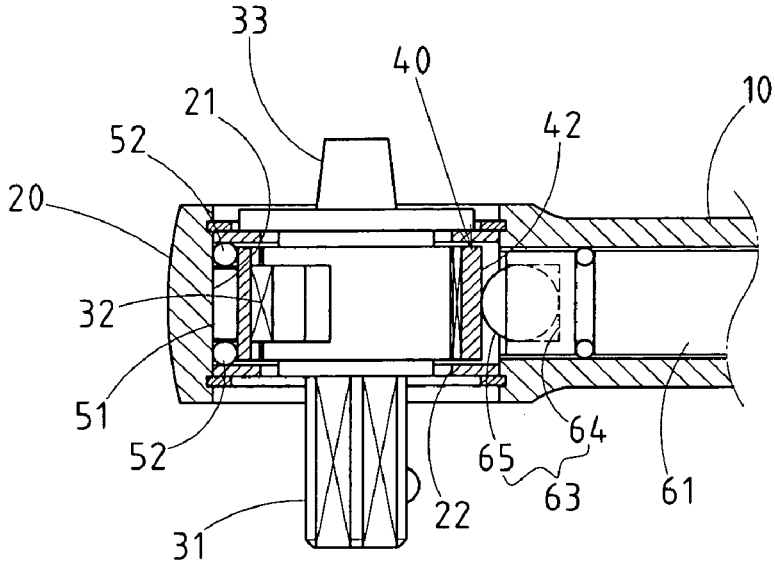

As shown in FIG. 4, various surfaces 40 of peripheral polygon of the overload movement ring 40 can be designed with a plain edge.

Figure 7:
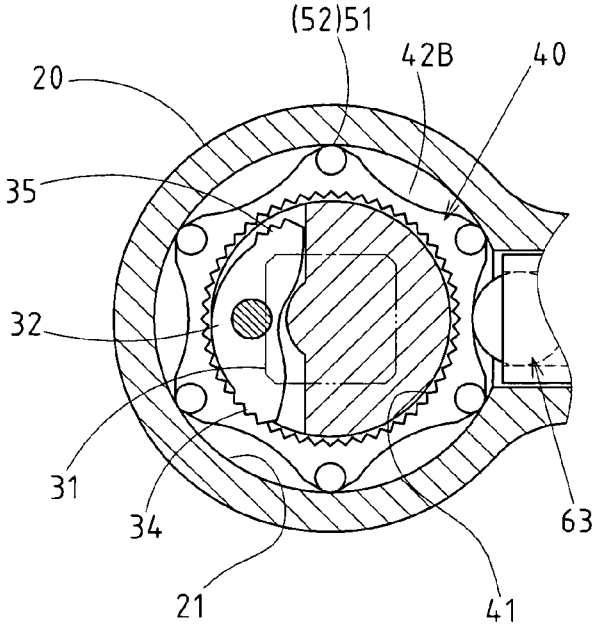
FIG. 7 shows a partial magnified sectional view of the peripheral plane of the overload movement ring.

As shown in FIG. 7, various surfaces 40B of peripheral polygon of the overload movement ring 40 can also be designed with a concave arch. As compared with the above-specified plain edge, this structural design can promote the torque as it provides a bigger grading angle to the bolster 63 of the movable shore 61 when crossing over the rolling rod 51 and rolling bead 52. Furthermore, this design can prevent continuous cross/movement as the bolster is securely fixed onto the next surface.

As shown in FIG. 4, the bolster 63 of the movable shore 61 is designed with a groove 64 wherein a rolling bead 65 is placed. Once the friction takes place between the overload movement ring 40 and bolster 63, it can help reduce the friction coefficient to guarantee a smooth movement thanks to its rolling feature of rolling bead 65.

Figure 8:
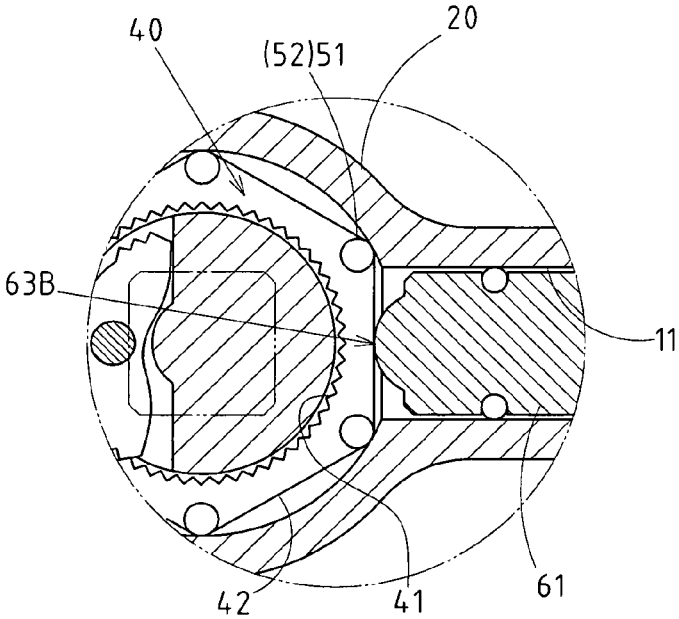
FIG. 8 shows another partial magnified sectional view of the application of the bolster of movable shore.

As shown in FIG. 8, the bolster 63B of the movable shore 61 can also be designed with a circular flange at the end of the movable shore 61.

Figure 6:
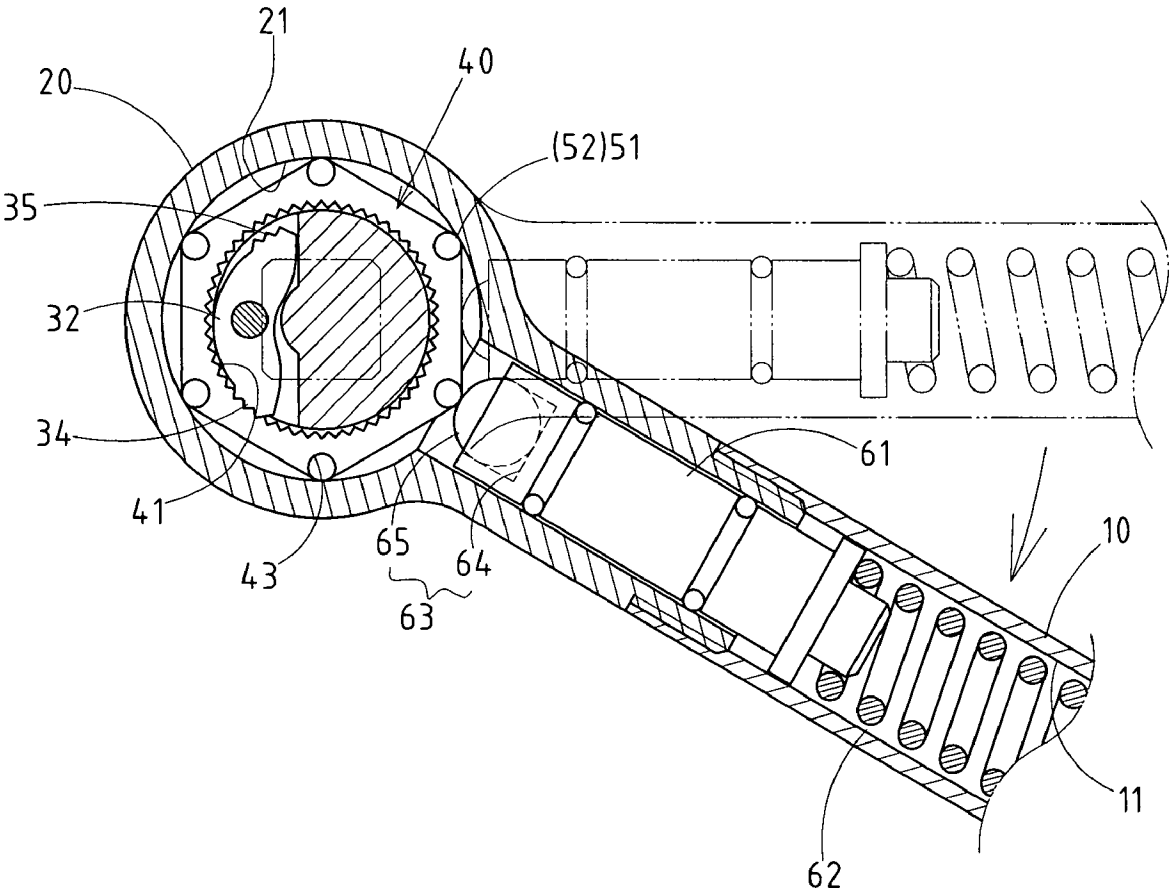
FIG. 6 shows another sectional view the overload state of the torque wrench.

Based upon the above-specified structure and construction of torque wrench for this utility model, the exterior surface 42 of the overload movement ring 40 is supported flexibly by the bolster 63 of the movable shore 61 as shown in FIG. 4, with the elastic force depending on the spring 62. Under normal service state, the supporting force of the bolster 63 is enough to activate the overload movement ring 40 to rotate simultaneously, namely capable of screwing the bolt when it activates the sheath rod 31 of directional brake module 30 to rotate. But, if the resistance arising from screwing the bolt is bigger than the force fixing the overload movement ring 40, it will be activated by the sheath rod 31. In such case, the exterior of the overload movement ring 40 is placed in a rolling contact state through the rolling rod 51, rolling bead 52 and the assembly groove 21 of the sheath end 20, enabling the overload movement ring 40 to generate rotary motion within the assembly groove 21. During rotation, the bolster 63 of the movable shore 61 will cross over a rolling rod 51 from the surface 42 of overload movement ring 40 (as shown in FIG. 6), then stop at the next surface 42. Finally, it will be placed into initial supporting state again.

I claim:

1. A torque wrench comprising:

a pressure handle provided internally with a hollow hole;

a sheath end provided at one side of the pressure handle, and comprised of an assembly groove; said assembly groove having a threaded hole at a bottom thereof, while one side of said assembly groove opposite to said pressure handle is connected to said hollow hole;

a directional brake module mounted within said assembly groove and comprised of a sheath rod, a brake section and a control unit, said sheath rod crossing through said threaded hole while said control unit adjusts direction of said brake section;

an overload movement ring provided between said brake section and said assembly groove, an interior of said overload movement ring having a circular tooth rim for articulation of said brake section and an exterior as a polygon; wherein a containment groove is provided at an intersection of various surfaces penetrating both sides thereof, an exterior of various containment grooves having a reducing aperture corresponding to a wall of said assembly groove;

a rolling rod and rolling bead provided within various containment grooves at the exterior of overload movement ring, each end of a rolling rod having a rolling bead, outer flanks of various rolling rods and rolling beads protruding from an aperture of said containment groove and keeping in close contact with said wall of said assembly groove; and a spring bolster provided within said hollow hole and comprised of a movable shore and a spring; wherein one end of said movable shore is supported by said spring while an opposite end has a bolster that crosses over said assembly groove and supports a surface corresponding to the exterior of the overload movement ring.

2. The torque defined in claim 1, wherein various surfaces of peripheral polygon of said overload movement ring have a plain edge.

3. The torque defined in claim 1, wherein various surfaces of peripheral polygon of said overload movement ring have a concave arch.

4. The torque defined in claim 1, wherein said bolster of said movable shore is comprised of a groove wherein a rolling bead is placed.

5. The torque defined in claim 1, wherein said bolster of said movable shore is comprised of a circular flange at an end of the movable shore.

* * * * *